US008375659B2

(12) United States Patent
Bogenhagen et al.

(10) Patent No.: US 8,375,659 B2
(45) Date of Patent: Feb. 19, 2013

(54) ACCESSIBLE SILL WITH FLEXIBLE DAM FOR WATER CONTAINMENT AND DRAINAGE

(75) Inventors: David Bogenhagen, Hudson, WI (US); Jon Dekko, Grant, MN (US); Duane Fier, Hudson, WI (US)

(73) Assignee: Andersen Corporation, Bayport, MN (US)

( * ) Notice: Subject to any disclaimer, the term of this patent is extended or adjusted under 35 U.S.C. 154(b) by 67 days.

(21) Appl. No.: 12/821,389

(22) Filed: Jun. 23, 2010

(65) Prior Publication Data

US 2010/0325982 A1 Dec. 30, 2010

Related U.S. Application Data

(60) Provisional application No. 61/219,871, filed on Jun. 24, 2009.

(51) Int. Cl.

| | |
|---|---|
| ***E06B 1/04*** | (2006.01) |
| ***E06B 7/14*** | (2006.01) |
| ***E06B 1/70*** | (2006.01) |
| ***E06B 7/16*** | (2006.01) |

(52) U.S. Cl. ..... 52/211; 49/408; 49/467; 49/469; 49/470; 49/471; 49/495.1; 52/209

(58) Field of Classification Search ..... 52/209, 52/211; 49/408, 467, 469, 470, 471, 495.1
See application file for complete search history.

(56) References Cited

U.S. PATENT DOCUMENTS

| | | | | |
|---|---|---|---|---|
| 693,230 | A * | 2/1902 | Burkey | 49/489.1 |
| 2,718,677 | A * | 9/1955 | Cornell | 49/469 |
| 2,933,781 | A * | 4/1960 | Cornell | 49/468 |
| 3,079,652 | A * | 3/1963 | Wahlfeld | 49/469 |
| 3,535,824 | A * | 10/1970 | Kessler | 49/475.1 |
| 3,654,730 | A * | 4/1972 | Fraleigh | 49/34 |
| 4,055,917 | A * | 11/1977 | Coller | 49/469 |
| 4,213,275 | A * | 7/1980 | Oehmig | 49/468 |
| 5,687,508 | A * | 11/1997 | Fitzhenry et al. | 49/471 |
| 6,289,635 | B1 * | 9/2001 | Procton et al. | 49/467 |
| 6,374,545 | B1 * | 4/2002 | Baczuk | 49/470 |
| 6,637,158 | B2 * | 10/2003 | Bennett | 49/504 |
| 6,763,639 | B2 * | 7/2004 | Bennett et al. | 52/212 |
| 8,074,699 | B2 * | 12/2011 | Jones et al. | 160/206 |
| 2008/0229669 | A1 * | 9/2008 | Abdollahzadeh et al. | 49/468 |
| 2009/0038231 | A1 * | 2/2009 | Erbrect et al. | 49/476.1 |

* cited by examiner

*Primary Examiner* — Joshua J Michener
*Assistant Examiner* — Keith Minter
(74) *Attorney, Agent, or Firm* — Womble Carlyle Sandridge & Rice, LLP

(57) ABSTRACT

A handicap accessible doorway includes a frame having side jambs and a low profile sill extending between the bottom portions of the jambs. A flexible fin extends along the length of the sill and projects upwardly therefrom to form a water dam. The flexible fin is sealingly attached at each end to a jamb. During a blowing rainstorm, water is contained by the dam and directed to a contain-and-drain water management system, which directs the water away from the doorway to an exterior weep hole or other drain port. The fin, being flexible, yields to the weight of a footstep or a wheelchair thereby maintaining the handicap accessible designation of the sill and the doorway.

17 Claims, 4 Drawing Sheets

ACCESSIBLE SILL WITH FLEXIBLE DAM FOR WATER CONTAINMENT AND DRAINAGE

REFERENCE TO RELATED APPLICATION

Priority is hereby claimed to the filing date of U.S. provisional patent application Ser. No. 61/219,871 filed on 24 Jun. 2009 and entitled Accessible Sill with Flexible Dam for Water Containment and Drainage.

TECHNICAL FIELD

This disclosure relates generally to doorways and more specifically to handicap accessible doorways with low profile sills.

BACKGROUND

Low profile accessible sills are used to provide easier access to buildings by handicapped individuals in wheelchairs. However, controlling leakage where the door meets an accessible sill has been a problem at least in part because of the one-half inch maximum height limitation for handicap accessible sills. Thus, accessible sills generally have not performed well in blowing rainstorms and typically are assigned a "limited water" (LW) rating for product performance. Previous efforts at water management for low profile sill designs have attempted to create a perfect seal between a frame, sill, and a closed door panel. This is known as "barrier" design and, in theory at least, is sound. However, barrier design often fails to result in a perfect seal when subjected to variations in piece part manufacturing, door assembly at the manufacturing facility, door installation at a building site, and forces of weathering and normal use. As a result, leakage, particularly in blowing rainstorms, is generally inevitable.

Thus, there is a need for a low profile handicap accessible door sill that addresses water leakage problems with prior art accessible sills without relying on a barrier design that rarely meets the design target of a perfect seal and does not form a reliable seal. It is to the provision of such an accessible sill and an accessible doorway incorporating the sill that the present invention is primarily directed.

SUMMARY

The entire content of U.S. provisional patent application 61/219,871, to which priority is claimed above, is hereby incorporated by reference as if fully set forth herein.

Briefly described, a low profile accessible door sill has hard surfaces that meet the requirement that the sill be no more than one-half inch tall. However, a water retention fin made of flexible rubberized or elastomeric material projects upwardly from the top surface of the sill beneath a closed door and forms a barrier or dam against water. The water retention fin is sealingly attached to the threshold and to each jamb of the doorway, so as to confine any water passing beneath the door panel to the exterior side of the retention fin. In a blowing rain, the dam encounters and stops water that might otherwise blow beneath the door and into a building. Water that collects behind the dam can be directed to a contain-and-drain water management system that directs the water to the outside of the doorway and drains it away. Thus, the sill and doorway can be assigned a rated water performance higher that LW. However, since the flexible dam yields to the weight of a wheelchair or footsteps, the sill effectively stays under the one-half inch limit and the doorway can therefore retain its handicap accessible designation.

Thus, a handicap accessible doorway is now provided that exhibits a higher rated water performance than prior doorways while meeting the standards set for accessible sills and doorways. These and other features, aspects, and advantages will be better understood upon review of the detailed description set forth below, taken in conjunction with the annexed drawing figures, which are briefly described as follows.

DETAILED DESCRIPTION

As used herein, the term "exterior" will refer to orientation toward or on a side toward the outside of a building in which an entryway according to this disclosure is installed and "interior" will refer to orientation toward or on a side toward the inside of such a building.

Figure 1:
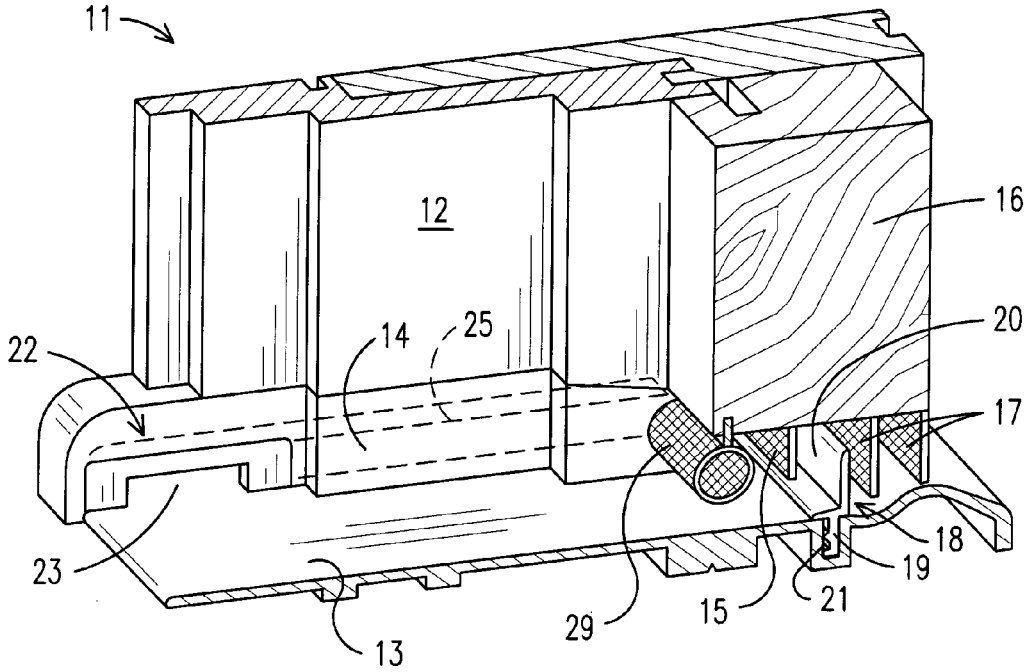
FIG. 1 is a perspective view of a portion of an accessible doorway and sill that embodies principles of the disclosure, and shown with the door panel closed.

Referring now in more detail to the drawings, wherein like reference numerals indicate like parts throughout the several views, FIG. 1 illustrates, in a first embodiment, the left bottom corner portion of an accessible doorway 11. The doorway includes a jamb 12, a sill 13, and a corner key or jamb boot 14 extending along the end of the sill and coupling the jamb to the sill. A door panel 16 is shown in its closed position overlying the sill 13 with a sweep fin 15 extending downwardly from door panel 16 toward the sill. The sweep fin 15 helps form a shield to knock down turbulent water and to create a quiescent air space in the region beneath the door panel and on the interior side of the sweep fin 15. Unlike some prior art sweeps, the fin 15 need not contact the sill in an attempt to form a seal, although a bulb seal 29 on the exterior side of the fin 15 may be provided for this purpose. Rather, fin 15 allows water to pass beneath it so that the water can be contained and drained as described in more detail below.

With continued reference to FIG. 1, the sill 13, which may be made of extruded aluminum, has a longitudinal slot 21 and, although not shown in the figures, the corner key 14 is formed with a contiguous slot extending vertically. A flexible rubberized or elastomeric fin unit 18 is formed with a depending tang 19 designed to fit and lock within the slot 21 to mount the fin unit to the sill so that its fin 20 projects upwardly to form a barrier or dam extending along the length of the sill. The fin unit 18 is also formed with a base 24 and an upstanding end 26 with a continuous integral vertical tang (not visible) that fits tightly in the vertical slot of the corner key. Also, during the manufacturing process, a sealant backfill can be added by injecting silicone between the sill, fin unit, and corner key to enhance the integrity of the seal at the corner. As such, the fin unit 18 forms a watertight yet flexible dam that intercepts and stops water that might otherwise pass beneath the door panel and into the interior of a dwelling.

Figure 5:
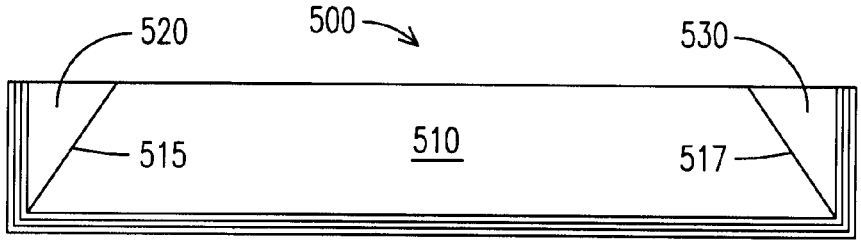
FIG. 5 illustrates a flexible fin having parts produced by mitering and welding.

Fin 18 may be produced from a variety of materials. One particularly useful class of materials is thermoplastic vulcanizates. Thermoplastic vulcanizates are polymeric materials comprising a vulcanized rubber phase dispersed in a thermoplastic matrix. Materials of this sort are able to achieve some of the desirable properties of vulcanized rubber, such as low temperature flexibility, while still being processable as thermoplastics. A suitable thermoplastic vulcanizate is Santoprene, commercially available from Exxon Mobil Chemical of Akron, Ohio (exxonmobilchemical.com), which is a thermoplastic elastomer available in grades that can be selected to remain flexible at low temperatures and yet remain sufficiently abrasion resistant and robust at higher temperatures to withstand use in a threshold. Fin unit 18 may be manufactured by any suitable method. Referring to FIG. 5, for example, central portion 510 may be produced by extrusion of a thermoplastic vulcanizate, and miter cut along lines 515 and 517. Mitered end pieces 520 and 530, from the same extrusion, can then be welded onto central portion 515. In an alternative method of manufacture, central portion 510 can be produced by extrusion, and cut to a suitable length. The ends of portion 510 can then be placed in a mold that molds the end pieces onto the central portion. This method provides the advantage of a reliably joined unitary product along with the ability to produce fin units to fit a range of different door sizes and having a wide range of end configurations. It will be appreciated that other materials, such as polyurethanes, may be used, provided they exhibit the requisite physical properties and that the fin can be manufactured by a suitable process.

Figure 6:
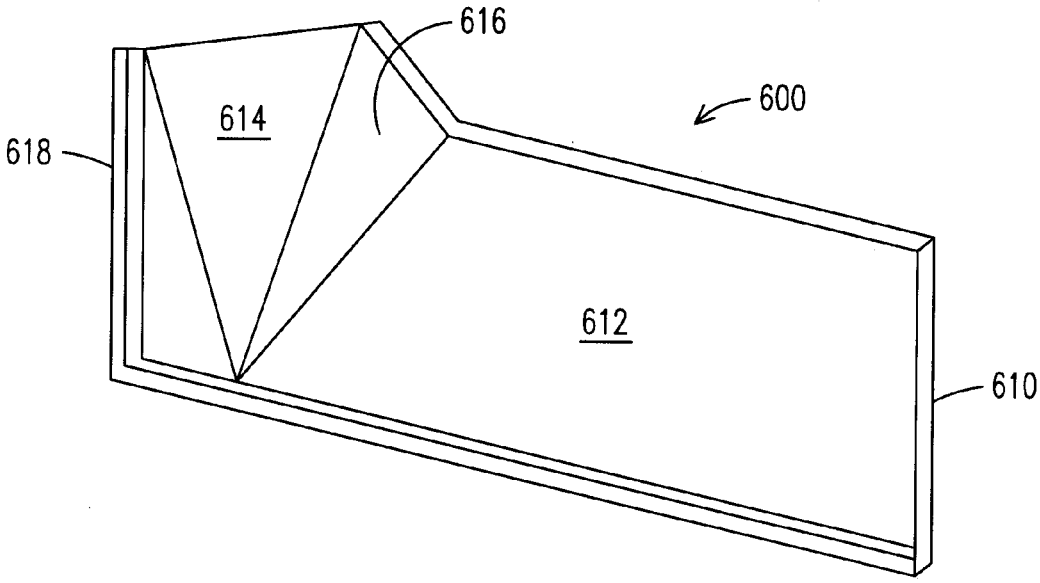
FIG. 6 illustrates a flexible fin incorporating pleats to reduce stress during passage of a wheelchair causing the fin to be flattened.

Production of the end portions of the fin unit by molding enables additional features to be provided. Referring to FIG. 6, for example, it may be useful to provide triangular folds or pleats 614 and 616 into end piece 600, so as to reduce stress due to stretching of the fin material. More specifically, when a wheelchair or other conveyance passes over the fin unit or an individual steps on the unit, vertical portion 612 folds down and is flattened. In response, the angle between pleats 614 and 616 straightens, and the stress that otherwise be induced in the fin unit is reduced.

In alternative embodiments, different portions of the fin unit can be made from different materials, by, for example, coextrusion or multiple shot molding techniques well known in the art. In one embodiment, the base portion 24 and upstanding portion 26 can be made from a material having a higher elastic modulus than fin portion 20. Tang 19 can be made from a material suitable for secure insertion and holding into slot 21. Different mechanical properties for the different portions of the fin unit can be obtained, for example, by adding fillers to the materials making up the portions of the fin unit requiring a higher elastic modulus and optionally adding plasticizers to the materials making up the portions requiring a lower elastic modulus. By using the same base polymer for all portions of the fin unit, joining of the different portions can be simplified.

In another alternative embodiment, the fin unit is produced without a base portion, with the depending tang attached directly to the vertical fin portion. In yet another embodiment, the fin unit is produced without the upstanding end piece, with the vertical fin portion fitting directly into a slot in the door frame, held in place, for example, by molded in tangs, silicone or other adhesive sealant, mechanical clamping, or combinations thereof. Other configurations are possible within the scope of the present invention.

The corner key 14 is formed with an internal drain channel 25 that communicates between an entrance or mouth 27 (FIG. 2) and a weep hole or outlet 22 located on the exterior side of a door unit. Together, these components form a "contain-and-drain" pathway for the management of water that collects on the sill, as detailed below. A weep door 23 is provided in the weep hole 22 to prevent foreign matter from entering the contain-and-drain pathway. It should be understood that the contain-and-drain system shown in the figures is but one possible embodiment of such a system that might be used to manage water. The management of rainwater can be accomplished through the corner key as shown, through a side jamb, or through the sill itself. Further, prevention of foreign matter from entering the contain-and-drain pathway can be accomplished by a weep door 23 as shown in the illustrations, continuous or intermittent pieces of filter material within the pathway, forming turns and/or steps in the pathway, or combinations thereof. The present invention is not limited to the illustrated embodiments, but is intended to include these and other equivalent alternatives for managing collected water and directing it away from the doorway.

Figure 2:
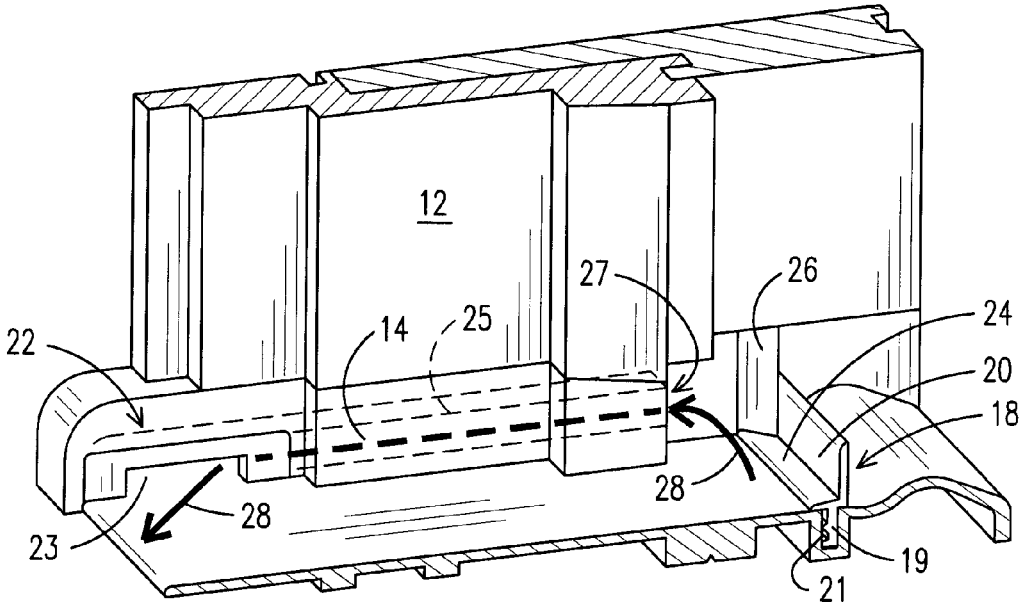
FIG. 2 is a perspective view of the same portion of an accessible doorway and sill shown with the door panel removed or open.

FIG. 2 illustrates better the combination of the flexible fin unit 18 that forms a dam against the ingress of water across the sill 13, and the corner key 14, which contains a drain channel 25. The fin unit 18 includes a depending barbed tang 19 that is received and tightly held within slot 21 formed along the length of the sill. The base 24 of the fin unit 18 rests atop the sill to hold the fin 20 in its upright orientation and an integral continuous end 26 with a continuous vertical tang insures a watertight seal at the lower corner of the doorway. As illustrated in FIG. 2, rainwater that may collect on the sill in, for example, a blowing rain, is contained by the dam formed by the fin unit 18 and migrates toward the bottom corners of the entryway, as illustrated by arrows 28. At the corners of the doorway, the contained water flows into the contain-and-drain pathway or channel 25 through its mouth or entrance 27. The water then flows along the contain-and-drain pathway as indicated by the dashed lines until it drains out of the pathway through the weep hole 22. Thus, water that might otherwise be blown beneath the door panel is stopped by the flexible fin and channeled away from the doorway through the contain-and-drain water management system.

Since the fin unit 18 is made of a flexible elastomeric material, it readily yields or bends down in response to the weight of a person stepping on the sill or the weight of a wheelchair rolling across the sill. Therefore, although the fin unit forms a very effective dam against water leakage across the sill, it nevertheless does not interfere with the primary function of a handicap accessible sill. Further, even though the flexible fin projects upwardly beyond the one-half inch maximum height for accessible sills, all of the hard surfaces of the sill remain within the limit so that the sill of this invention can still be designated as a handicap accessible sill.

Figure 3A:
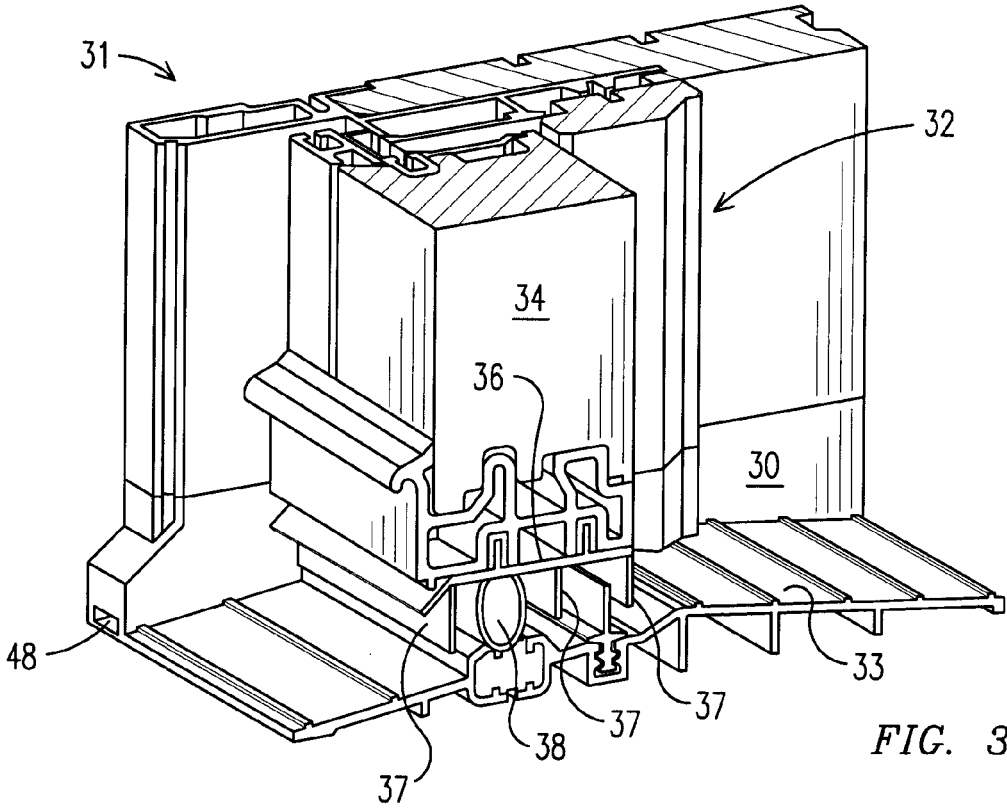
FIGS. 3*a* and 3*b* illustrate another embodiment of the disclosed doorway and sill for use with an outswing style accessible doorway.
Figure 3B:
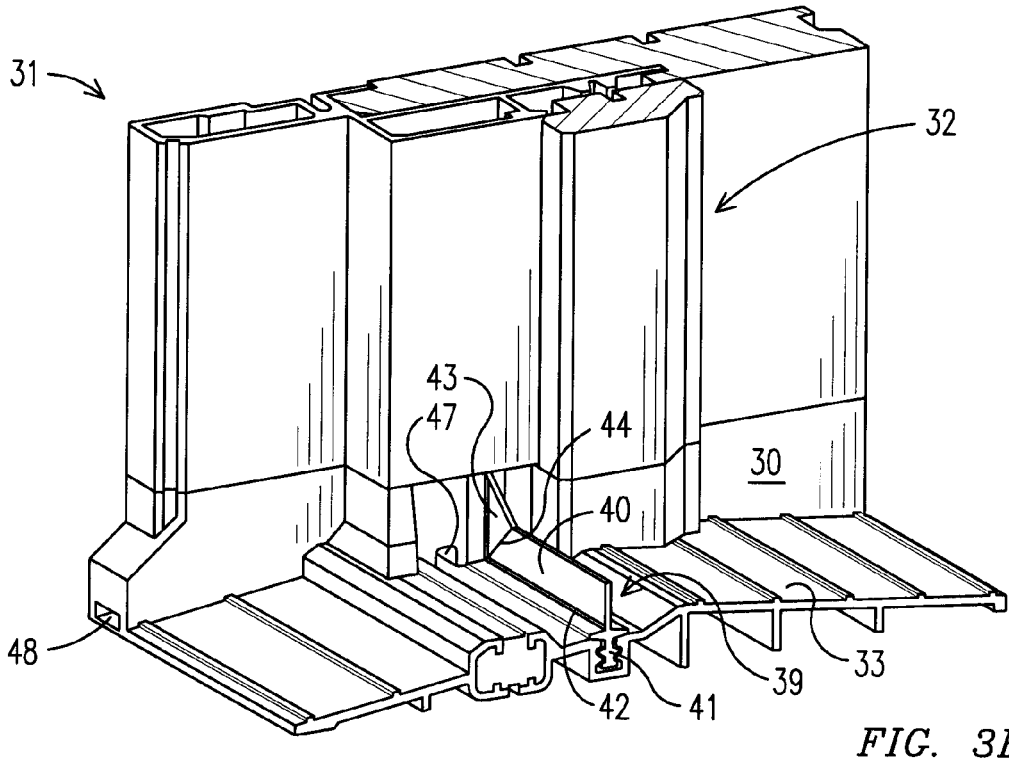

FIGS. 3*a* and 3*b* illustrate another embodiment of the system disclosed herein for use with an outswing accessible doorway. A bottom left corner of the doorway is illustrated, but those of skill in the art understand the design of the doorway from the illustrated portion. The doorway 31 includes vertical jambs 32 with a horizontal low profile sill 33 extending between the jamb bottoms and coupled to the jambs via a molded corner key 30. The corner key is formed with an internal drain channel that communicates between an inlet 47 (FIG. 3*b*) and a exit or weep hole 48 at the forward end of the corner key. A water containment fin unit 39 extends along the sill 33 and has a barbed tang 41 that fits tightly with a friction fit within a groove formed along the length of the sill. A base 42 that rests on the sill 33 supports an upwardly extending flexible water containment fin 40 that projects upwardly from the surface of the sill. A vertically extending end portion 43 is miter welded to the ends of the fin unit 39 and extends upwardly toward the top of the corner key. Preferably, the corner key has a groove that is contiguous with the groove in the sill and the end portion has a barbed tang that fits and is held with friction in the groove. This along with the unitary welded end portion forms a reliable and continuous seal at the corner. If desired, the corner portion can be backfilled with a sealant such as silicone to enhance the integrity of the seal even further.

An outswing door panel 34 (FIG. 3*a*) closes the doorway and includes a sweep 36 having an array of depending fins 37 that extend downwardly toward but do not touch the surface of the sill. These fins form a shield against turbulent water and also help to deaden the air beneath the door. A bulb seal 38 that does contact the sill may be provided if desired outboard of the fin 40, with the space between the bulb seal and the flexible fin 40 forming a reservoir where water that seeps beneath the door can be contained. It will be seen from FIG. 3*b* that the inlet 47 to the drain channel within the corner key is located within this water containment region. Thus, water that may be stopped and contained by the fin unit 39 tends to flow toward the ends of the sill where it enters the drain channels through inlets 47 and is directed to the weep holes 48 to be drained away from the doorway. In the embodiment of FIGS. 3*a* and 3*b*, a volume of open cell filter fabric (not visible) is disposed within the drain channel to prevent insects and debris from entering the drain channel and to inhibit backflow of rainwater through the channel. Both filter fabric and a weep hole door can be used if desired to provide additional protection against clogging and backflow.

Figure 4A:
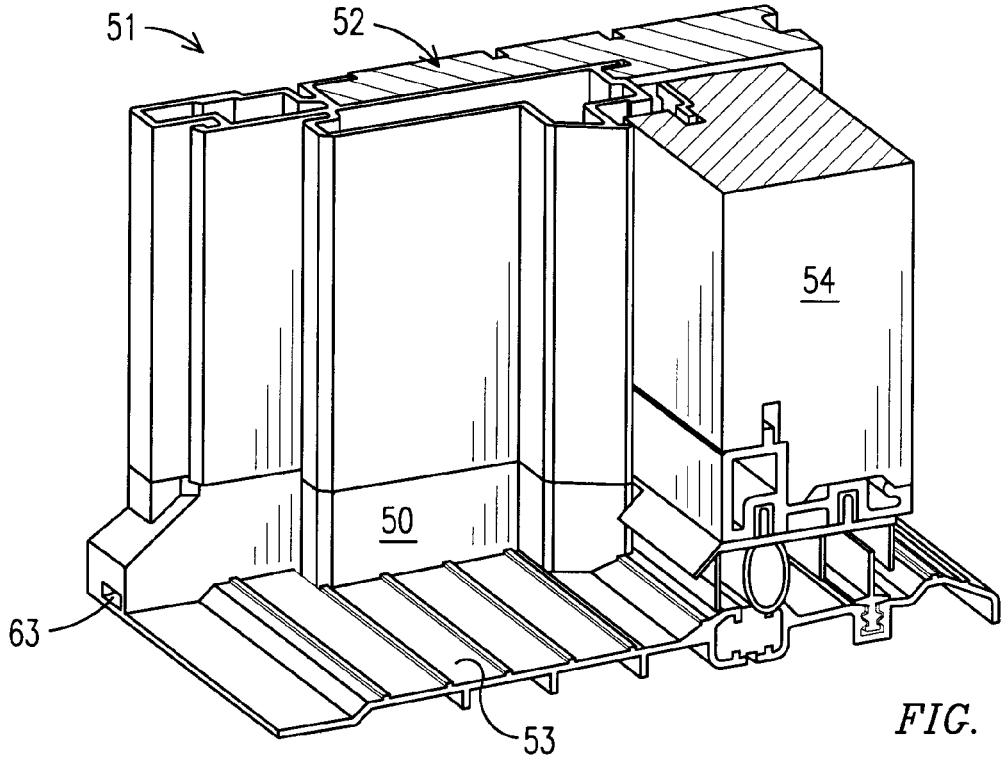
FIGS. 4*a* and 4*b* illustrate another embodiment of the disclosed doorway and sill for use with an inswing style accessible doorway.
Figure 4B:
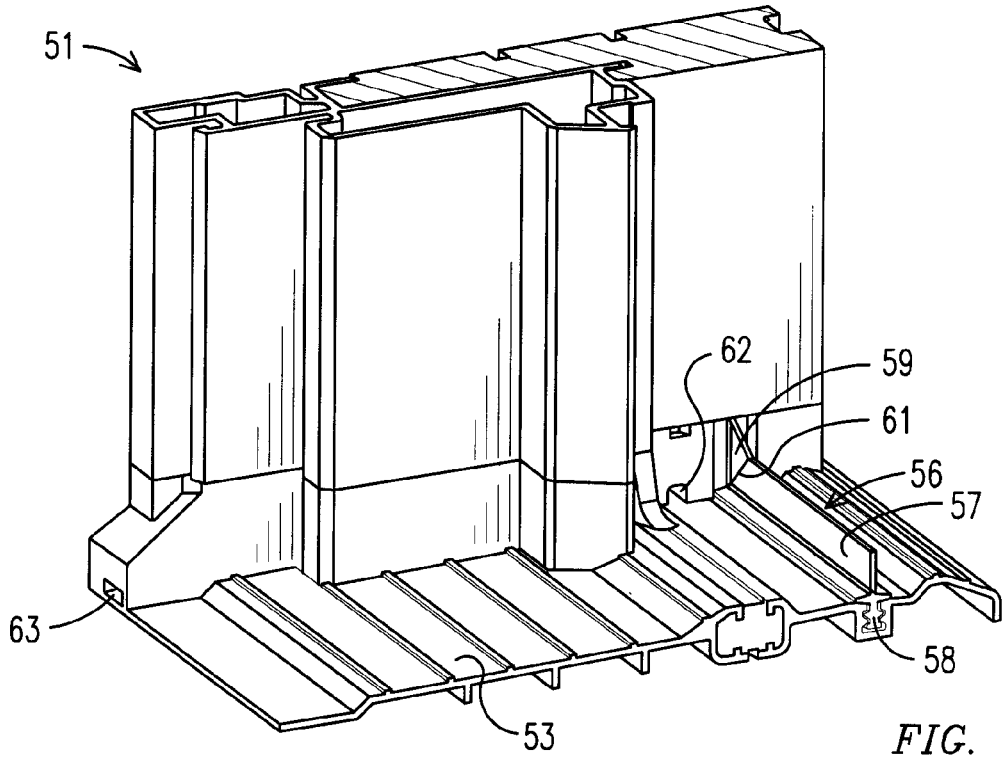

The embodiment of FIGS. 4*a* and 4*b* is similar in most respects to that of FIGS. 3*a* and 3*b* and thus need not be discussed in as much detail here. Briefly, however, this embodiment is for use with an inswing accessible doorway 51 and includes a jamb 52, a low profile sill 53, a corner key 50, and a closable door panel 54. A water containment fin unit 56 is secured within a groove extending along the sill by a depending barbed tang 58 and includes a base and an upstanding flexible fin 57. An end piece 59 is miter welded to the end of the fin unit 56 so that it is continuous and unitary therewith. The end piece 59 preferably has a barbed tang continuous with that of the fin unit 56 secured within a groove in the corner key that is contiguous with the groove in the sill. The corner also may be backfilled with a sealant such as silicone if desired. As seen in FIG. 4*a*, the door panel 54 includes a sweep that has an array of depending sweep fins that form shields and a depending bulb seal that contacts and forms an at least partial seal with the sill. The space between the bulb seal and the fin 57 defines a water containment region. An inlet 62 (FIG. 4*b*) to the internal drain channel of the corner key is located in this region so that water contained here can enter the drain channel and be drained away from the doorway through weep hole 63. Preferably, the drain channel contains filter material to prevent ingress of debris and backflow of water, as in the embodiment of FIGS. 3*a* and 3*b*. For each of these embodiments, the weep hole 48 and 63 is positioned as low as possible to maximize the head of water that the doorway of this invention can withstand.

Accordingly, it will be seen that the sill design described herein allows a water column to build behind the flexible water retention fin that is higher than the highest rigid feature of the overall sill. This, in turn, enables a contain-and-drain water management system to perform at rated levels of water performance by the fenestration industry performance rating scales. The flexible fin yields to the weight of a wheelchair or footsteps so that the sill effectively stays under the one-half inch limit of sill height for use in a handicap accessible doorway.

The invention has been described herein in terms of preferred embodiments and methodologies considered by the inventor to include the best modes of carrying out the invention. It will be understood, however, that a wide variety of additions, deletions, and substitutions might be made by skilled artisans without departing from the spirit and scope of the invention, which is not limited by the preferred embodiments illustrated here.

What is claimed is:

1. A wheelchair accessible doorway comprising:

a threshold having a first end, a second end, an interior edge portion, and an exterior edge portion, the threshold extending along a bottom of the doorway;

a first vertical jamb attached at a bottom end to the first end of the threshold;

a second vertical jamb attached at a bottom end to the second end of the threshold;

a door panel;

a flexible water retention fin sealingly attached to and projecting upwardly from the threshold, the flexible water retention fin also being sealingly attached both to the first vertical iamb, and to the second vertical jamb and extending partially up said iambs from the threshold; and the flexible water retention fin being reversibly collapsible such that the threshold has a height of 0.5 inches or less when the flexible water retention fin is collapsed toward the interior edge portion or toward the exterior edge portion of the threshold in response to passage of a wheelchair across the threshold; and a first corner key connecting the first jamb to the first end of the threshold and a second corner key connecting the second jamb to the second end of the threshold, wherein the fin is sealingly attached to the first corner key and the second corner key.

2. The doorway according to claim 1 wherein a portion of the fin fits sealingly into a groove in the threshold.

3. The doorway according to claim 1 wherein a portion of the fin fits sealingly into a groove in the first corner key and a portion of the fin fits sealingly into a groove in the second corner key.

4. The doorway according to claim 1 wherein at least one corner key comprises an enclosed drainage channel having an entrance proximate the fin and an exit at the exterior side of the doorway.

5. The doorway according to claim 1 wherein the fin comprises:

a base portion adjacent to a top portion of the threshold;

a flexible fin portion extending vertically upward from the base portion;

a first upstanding end portion integrally attached in a watertight manner to a first end of the flexible fin portion, further integrally attached in a watertight manner to the base portion, and oriented substantially perpendicular to the flexible fin portion and to the base portion;

a second upstanding end portion integrally attached in a watertight manner to a second end of the flexible fin portion, further integrally attached in a watertight manner to the base portion, and oriented substantially perpendicular to the flexible fin portion and to the base portion;

a depending tang attached to the base portion, wherein the tang is received by a channel in the threshold, and wherein the fin is located below the door panel, and wherein the first upstanding end portion is adjacent to the first vertical jamb of a door assembly and the second upstanding end portion is adjacent to the second vertical jamb of the door assembly.

6. The door assembly according to claim 5 further comprising a first tang extending from the first upstanding end portion toward the first jamb and received by a channel in the first jamb, and a second tang extending from the second upstanding end portion and received by a channel in the second jamb.

7. The doorway according to claim 5 wherein the fin comprises at least one folded portion that unfolds upon collapse of the fin.

8. An entryway comprising a framed opening having a pair of vertical jambs, a door panel in the framed opening and being movable between an open position and a closed position, a sill spanning the bottoms of the vertical jambs and positioned to underlie the door panel when in its closed position, the sill being one-half inch or less in height, and a flexible fin extending along the sill and projecting upwardly therefrom to intercept water that might otherwise be driven across the sill, the flexible fin being sealingly attached to the sill and having a first end that is sealingly attached to one of the vertical iambs and a second end that is sealingly attached to the other one of the vertical iambs, wherein the fin underlies the door panel when in its closed position.

9. The entryway of claim 8 and further comprising a first channel formed in the framed opening at one end of the sill, the first channel having an entrance positioned to receive water intercepted by the fin and an exit positioned to deposit the received water at a location displaced from the fin.

10. The entryway of claim 9 and further comprising a second channel formed in the framed opening at an opposite end of the sill, the second channel having an entrance positioned to receive water intercepted by the fin and an exit positioned to deposit the received water at a location displaced from the fin.

11. The entryway of claim 8 and further comprising a sweep fin depending from a bottom edge of the door panel, the sweep fin being positioned on an exterior side of the flexible fin when the door panel is in its closed position to create a quiescent air space between the sweep fin and the flexible fin.

12. The entryway of claim 11 and wherein the sweep fin is narrower than a space between the bottom edge of the door and the sill.

13. The entryway of claim 12 and further comprising a seal depending from the bottom edge of the door panel on an opposite side of the sweep fin from the flexible fin, the seal engaging and forming a substantial seal against the sill.

14. The entryway of claim 13 and wherein the seal is a bulb seal.

15. The entryway of claim 11 and further comprising at least one channel positioned to receive water from within the quiescent space and divert the water away from the entryway.

16. The entryway of claim 15 and wherein the at least one channel is located at one end of the sill.

17. The entryway of claim 16 and wherein the at least one channel comprises two channels located at opposite ends of the sill.

* * * * *